US009552010B2

(12) United States Patent
Monroe

(10) Patent No.: US 9,552,010 B2
(45) Date of Patent: Jan. 24, 2017

(54) LOCOMOTIVE HAND BRAKE TOOLS

(76) Inventor: Thomas P. Monroe, Temple, TX (US)

( * ) Notice: Subject to any disclaimer, the term of this patent is extended or adjusted under 35 U.S.C. 154(b) by 1227 days.

(21) Appl. No.: 13/412,877

(22) Filed: Mar. 6, 2012

(65) Prior Publication Data

US 2013/0233121 A1 Sep. 12, 2013

(51) Int. Cl.

| | |
|---|---|
| ***B25B 13/00*** | (2006.01) |
| ***G05G 1/04*** | (2006.01) |
| *B25B 13/28* | (2006.01) |
| *B25B 13/44* | (2006.01) |

(52) U.S. Cl.

CPC ..... *G05G 1/04* (2013.01); *B25B 13/28* (2013.01); *B25B 13/44* (2013.01); *Y10T 74/20864* (2015.01)

(58) Field of Classification Search

CPC ..... G05G 1/04; Y10T 74/20864; B25B 13/32; B25B 13/44; B25B 13/28; B25B 13/18

USPC ..... 81/488, 489, 128

See application file for complete search history.

(56) References Cited

U.S. PATENT DOCUMENTS

| | | | | | |
|---|---|---|---|---|---|
| 191,817 | A * | 6/1877 | Stearns | 30/495 |
| 1,009,609 | A * | 11/1911 | Wennebord | 29/560.1 |
| 1,188,918 | A * | 6/1916 | Dunlap | 81/128 |
| 1,638,990 | A * | 8/1927 | Elliott | 81/164 |
| 2,316,646 | A * | 4/1943 | Berkman | 29/217 |
| 2,491,623 | A * | 12/1949 | Sesak | 81/99 |
| 2,682,189 | A * | 6/1954 | Bergman | 81/119 |
| 2,745,305 | A * | 5/1956 | Reiffin | 81/128 |
| 3,008,723 | A * | 11/1961 | Caldweli | 279/53 |
| 3,631,549 | A * | 1/1972 | Stoneburg | 81/164 |
| 4,715,252 | A * | 12/1987 | Pella | 81/176.1 |
| 4,911,040 | A * | 3/1990 | Kim | 81/128 |
| 5,481,950 | A * | 1/1996 | Browning | 81/488 |
| 7,637,183 | B2 * | 12/2009 | Alvarado | 81/120 |
| 8,671,807 | B2 * | 3/2014 | Monroe | 81/177.2 |
| 8,806,994 | B2 * | 8/2014 | Smith et al. | 81/489 |

* cited by examiner

*Primary Examiner* — Hadi Shakeri
*Assistant Examiner* — Danny Hong
(74) *Attorney, Agent, or Firm* — The Culbertson Group, PC; Nathan H. Calvert

(57) ABSTRACT

An extension tool is provided for operating handwheels, such as those found on locomotive handbrakes. The tool includes a spinning handle and a tool body. The handle freely rotates about a longitudinal axis and provides a user with a spinning grip, allowing him or her to quickly and easily turn a handwheel. The tool body includes two or more jaws that clamp to the handwheel. The tool body additionally includes a screw mechanism for selectively tightening or releasing the jaws, in order to respectively attach or detach the tool from the handwheel as desired. Preferably, the screw mechanism further includes a drawbar that extends through an interior of the handle, and is adapted to move longitudinally to rotate the jaws. The drawbar is moved by rotating a threaded drawbar nut at an end of the tool.

17 Claims, 6 Drawing Sheets

LOCOMOTIVE HAND BRAKE TOOLS

TECHNICAL FIELD OF THE INVENTION

The present invention relates to handheld extension tools, and more particularly to extension tools for operating a hand wheel associated with a handbrake used on a railroad locomotive.

BACKGROUND OF THE INVENTION

This invention relates to the field of tools used in the railroad industry by locomotive engineers to aid in the application release of locomotive engine vertical handwheel handbrakes. The operation of locomotive handbrakes is, in principle, the same as the handbrakes used on railroad cars. Application of the brakes means to set the handbrake to a "stop" position in which the locomotive will not move accidentally. Release of the brake means to set the handbrake to an "off" position in which the locomotive can be safely moved.

Locomotive handbrakes are placed on locomotives to be used in addition to the locomotive air brakes to keep the locomotives from moving while not in use, should the locomotive air brakes fail or be accidentally released by mistake. Handbrakes on locomotives are always left in the applied position when not being used.

One brake application release tool is shown in U.S. patent application Ser. No. 13/025,880, filed on Feb. 11, 2011. The tool is used for the application release of handbrakes on railroad freight and passenger cars. Where railroad car handbrakes are mounted on either the end or side of the car, the handbrakes on locomotive engines are typically mounted on the side of the locomotive engine compartment. The handbrake is operated from the locomotive walkway that extends the length of the engine compartment, from the rear of the locomotive to the locomotive cab. The handbrake is located so that the engineer or worker operates the brake at about waist or chest level relative to the handbrake wheel.

The handbrakes in both railroad cars and locomotives include a handbrake chain that tightens as the handbrake is applied by rotating the handbrake wheel. The biggest difference between handbrakes on railroad cars and handbrakes on locomotives is the amount of free slack in the handbrake chain. On railroad car handbrakes, this free slack is eliminated by about 2 to 4 revolutions of the wheel. However, in locomotive handbrakes, free slack is about 20 to 25 complete revolutions of the wheel. The handbrake must also be released completely when not in use, which requires reversing the process of setting the handbrake entirely. That is, turning the handwheel all the way until there is slack in the chain and the brake is fully released.

To begin the process of applying or releasing a locomotive handbrake, a railroad worker stands on the compartment walkway and grasps the handwheel with one or two hands. The worker then turns the handle in the clockwise direction to apply the brake, or in the counterclockwise direction to release the brake. This process may require the worker to re-grasp the wheel two to three times to complete one revolution of the handbrake wheel. Some operators may place two or three fingers at the junction of the handwheel inside rim and spoke, and rotate the handwheel continuously until all free slack is removed. Then, the worker grasps the handwheel at the highest point with one or both hands and fully applies the handbrake.

By trying to spin the handwheel with two or three fingers, an unsafe condition is created if the handwheel should suddenly stop and lock up. Some wheels offer continuous resistance to free spinning, and require too much force to utilize this method. This situation could also result in serious injury to the railroad worker's fingers. Therefore, a need exists for safe and effective tools for any railroad worker to remove the free slack in a handbrake chain.

Most new locomotives purchased by railroads around the time of filing, and those purchased in the prior decade, contain computers that monitor all aspects of the locomotive. These computers have sensors that trip an alarm should the handbrake not be completely released and someone tries to move the locomotive. Consequently, the handbrake handwheel must be rotated in the counterclockwise direction until it stops, and must be left in that position, in order for the locomotive computer to not trip the handbrake set alarm.

Should the locomotive handbrake handwheels have a permanently mounted handgrip on the handwheel, the handgrip would create a tripping or impact hazard, because it would be sticking out into the walking path of the railroad employee. Even if the handgrip were made to fold out of the way of the walking path, the handgrip could still become a tripping hazard due to bad maintenance or being accidentally left unfolded. The tripping hazard of a permanently mounted handgrip is increased by the fact that a high percentage of the times these walkways are traversed, they are done so at night and while the train is moving.

SUMMARY OF THE INVENTION

An extension tool is provided for enabling locomotive engineers and other railroad workers to easily remove the extreme amount of slack present in locomotives with vertical handwheel handbrakes. The tool comprises a spinning handle and a tool body connected to the handle for attaching to a handbrake wheel. The tool body has a tool body structure, a face that is constructed to sit against the handwheel, and jaws that clamp against the wheel. The jaws can be quickly opened or closed with an interior screw mechanism inside the tool body.

One goal of the present invention is to provide a tool that is both quickly attachable to and detachable from the vertical handbrake handwheel. This tool provides a secure method of turning the handbrake handwheel to safely and easily remove the extreme amount of slack in the chain.

Preferably, the tool comprises an elongated handle that freely rotates about a longitudinal axis. The freely rotating handle provides a user with a spinning grip, allowing the user to quickly and easily turn a handwheel. The tool also comprises a tool body, which further comprises two or more jaws that clamp to the handwheel. The tool body additionally comprises a screw mechanism for selectively tightening or releasing the jaws, in order to respectively attach or detach the tool from the handwheel as desired.

Preferably, the interior screw mechanism comprises a drawbar that extends through an interior of the handle, and is adapted to move along the longitudinal axis in order to selectively tighten or release the jaws. The screw mechanism may also comprise a threaded drawbar nut that interacts with a threaded portion of the drawbar to move the drawbar longitudinally, in order to tighten or release the jaws. In such embodiments, the tool may further comprise a compression spring that pushes against the drawbar, biasing the jaws into a certain position. The drawbar may further include a drawbar head that interacts with a drawbar head notch on each of the jaws, causing the jaws to undergo angular displacement with respect to the tool body.

In operation, a user attaches the tool to a wheel by fitting the jaws to the wheel, preferably at a spoke junction as shown in FIGS. 2A-2B, and rotating the drawbar nut to close the jaws around the wheel. The user can then turn the wheel easily while still applying substantial force because the tool handle grip spins on the handle.

A preferred embodiment of the tool includes a tool head body design so a face of the tool head fits flat against the outer junction between the handwheel rim and a spoke of the handwheel. Through the center of the tool head body there is a longitudinal hole centered around a longitudinal axis, preferably the full length of the tool head. Within the hole is a drawbar threaded on one end, and on the other end, provided with a double tapered, semi-rounded drawbar head larger than the diameter of the drawbar shaft. The drawbar is adapted to move along the longitudinal hole in order to selectively tighten or release the jaws. The tool head face has three slots at given angles, each slot constructed to receive a respective tool jaw. The three jaws are formed to bear against the inner and outer junction surfaces of the outer handwheel rim and one spoke of the wheel. A threaded drawbar nut is provided that interacts with the drawbar to longitudinally move the drawbar within the tool head in two directions, in order to tighten or release the jaws as desired by the operator.

Because of the way most handwheels are constructed, the three jaws are preferably rotationally asymmetric about the longitudinal axis in order to best accommodate the handwheel. However, some versions of the invention may have three jaws placed in rotational symmetry about the longitudinal axis. Other preferred versions of the invention use two jaws instead of three.

On preferred versions of the invention having three jaws, the jaws bear against the inner surface of the junction of the outer handwheel rim and one of the handwheel spokes. The jaws transmit multidirectional force to the handwheel rim. This is possible because, as the drawbar is tightened, each of the jaws pivots on a respective jaw attachment screw, causing the handwheel-spoke junction to be centered between the three jaws, and further causing the handwheel to be pulled toward the face of the tool head. This multidirectional force allows the tool to remain steady and in place while the handwheel is turned.

DETAILED DESCRIPTION OF PREFERRED EMBODIMENTS

Figure 1:
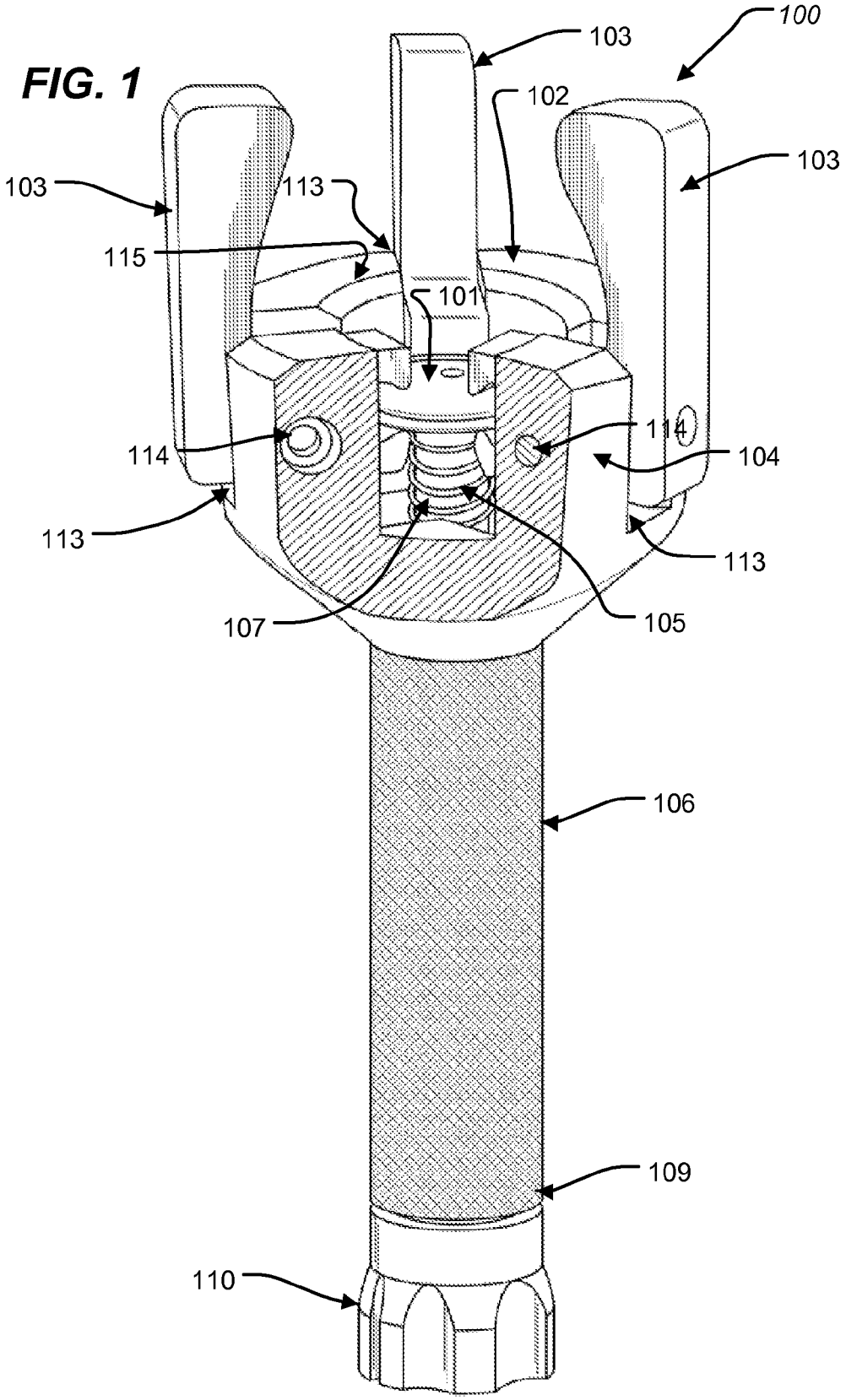
FIG. 1 is a perspective view of a tool according to one embodiment of the present invention.

FIG. 1 is a top perspective view of a tool according to one embodiment. The depicted tool 100 includes a handle 106 attached to a tool body, the main part of the tool body being the tool body structure 104. A cutout area is shown in tool body structure 104 in order to depict the inner parts of the tool head, but this is only for illustrative purposes and the preferred embodiment has a solid circular shape with the cutout area filled in.

Figure 5:
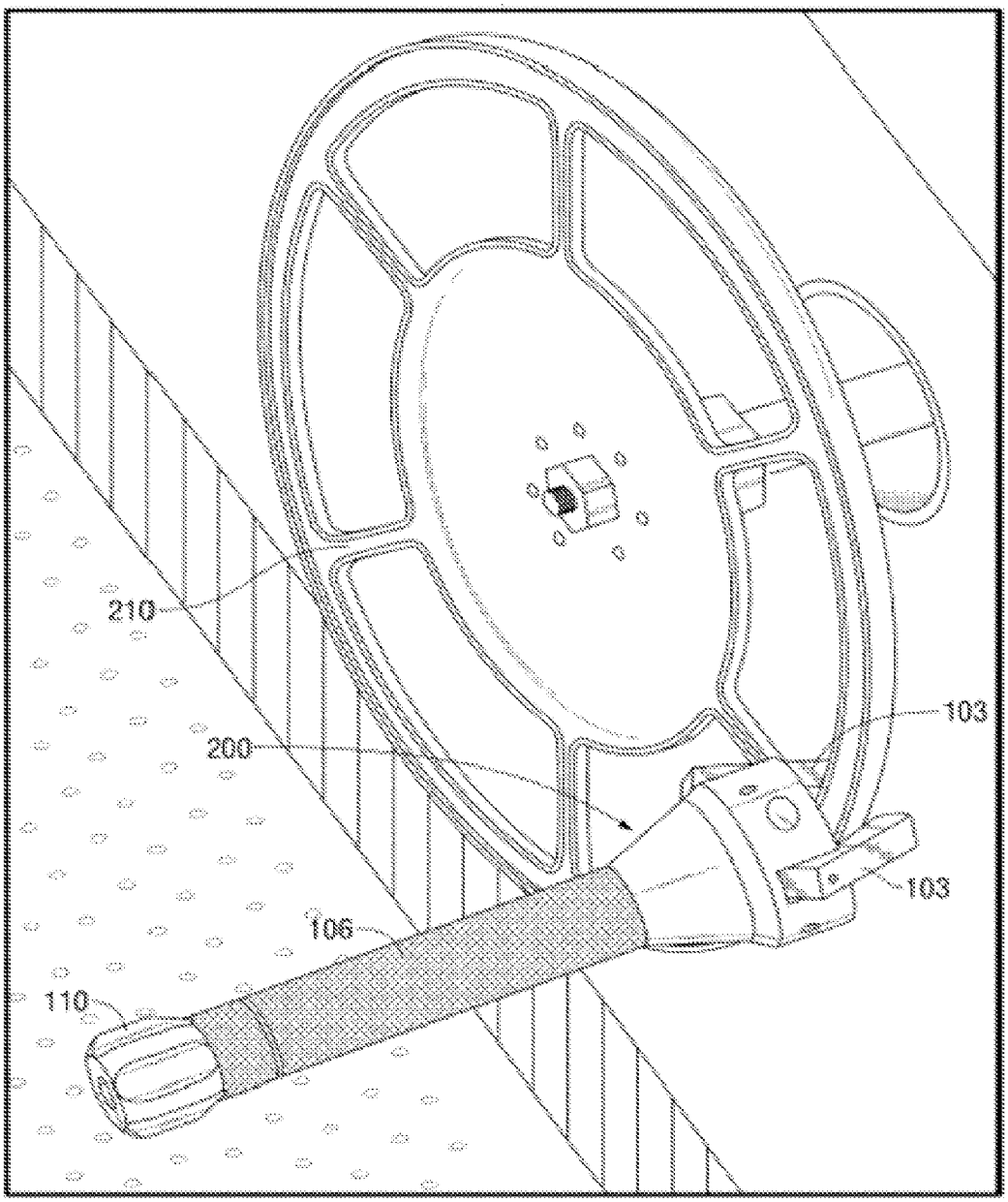
FIG. 5 is a perspective view of a tool attached to a handwheel.

This tool 100 is employed to provide a handle extension to the existing locomotive handbrake wheel. It serves as a useful tool to help remove the extreme amount of slack in handbrake chain. However, this tool is not a leverage increasing device, as one of the inventor's prior applications is directed to. The tool also provides improved safety by allowing a safe and secure hand placement option that will prevent injuries to employees' fingers while rotating the handbrake wheel. When the tool is attached to a handbrake handwheel (as shown in FIG. 5, for example), a rotating force is applied as the tool jaws 103 are tightened in place, which force positions the tool correctly along the wheel rim. Further, once tightened in place, the clamping force is applied to the handwheel in at least two directions due to the clamping pressure between the three jaws. A squeezing force is applied between tool body structure 104 and the jaws 103.

Although the depicted tool 100 is machined from aluminum, any suitable material may be used in accordance with the present invention. Such materials may include steel or other metals, rubber, wood, or plastic. For example, jaws 103 are preferably machined from a round piece of aluminum about 2.75"×6.25" long, but other suitable materials may be used as further described below.

The depicted tool body includes three jaws 103 connected to the tool body structure 104. The jaws 103 grasp the handbrake wheel when the tool is in use. The jaws 103 are attached to the tool body structure 104 by the jaw mounting screws 114. Each jaw 103 moves inside a jaw slot 113, as depicted. Jaws 103 are adapted to undergo angular displacement with respect to tool body structure 104 in order to apply or release the tool 100. Tool 100 has a tool body face 102 that, when applied to a handwheel, rests against the outside of the handwheel, and by its large diameter of approximately 2¾ inches, it provides a stable connection to operate the handwheel. In this embodiment, the tool 100 is configured to be applied at the junction of the outside handwheel rim and one spoke of the handwheel.

Figure 6:
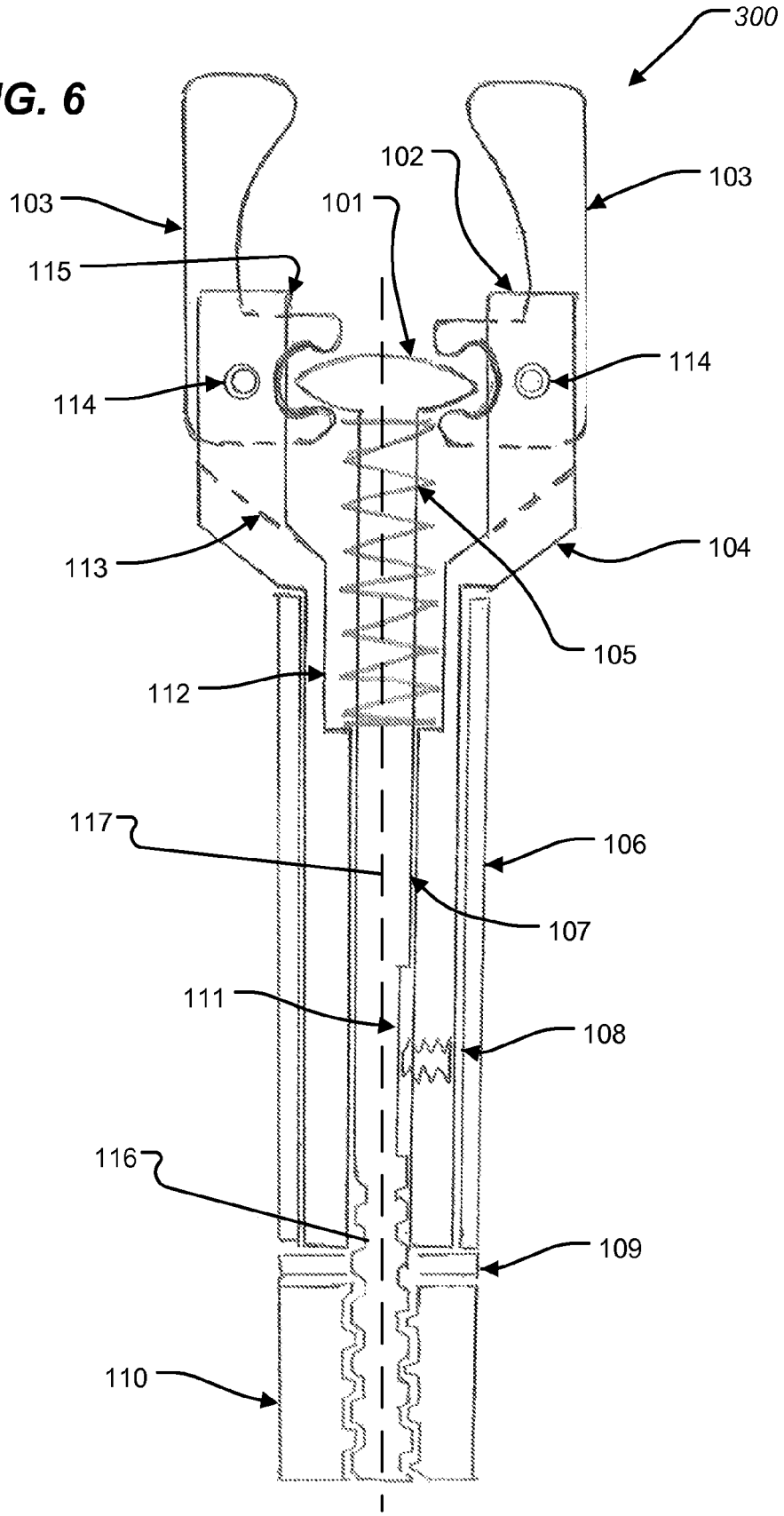
FIG. 6 is a cross section view of a tool according to another embodiment.

The tool body structure 104 has a ⅜ inch hole drilled through its center, and centered about a longitudinal axis 117 (FIG. 6). A drawbar 107 functions through this hole to move the jaws 103 back and forth. Drawbar 107 has a drawbar head 101 and a threaded drawbar end 116 (FIG. 6). In addition, drawbar 107 is attached to a compression spring 105 positioned to press against the drawbar head 101 in a manner to return the jaws 103 to the position shown in FIG. 1 when the tool 100 is not being used. That is, the jaws 103 spring open when not being used. The spring 105 is located behind the drawbar head 101, and inside a drawbar compression spring counter bore 112 (FIG. 6). Further details of the handle area construction including the drawbar 107 are also shown in the cross sectional view of FIG. 6. On the lower, threaded end of the drawbar 107 is a drawbar nut 110. The drawbar nut 110, which rotated clockwise, pulls the drawbar head 101 against the drawbar compression spring 105, and thus causes the jaws 103 to rotate into a closed position. The drawbar nut 110 also operates to return the jaws 103 to the open position when it is turned counterclockwise. A drawbar nut antifriction washer 109, located between tool body structure 104 and drawbar nut 110, is provided to keep the drawbar nut 110 from eroding the end of the tool body structure 104.

Tool 100 further includes a rotating handle 106 that surrounds an elongated portion of drawbar 107, and an elongated portion of tool body structure 104 (FIG. 6). Rotating handle 106 freely rotates about the central longitudinal axis of the tool 100. The freely rotating handle 106 thus provides a user with a spinning grip, allowing him or her to quickly and easily turn a handwheel, as may be best understood with respect to FIG. 5.

Figure 2A:
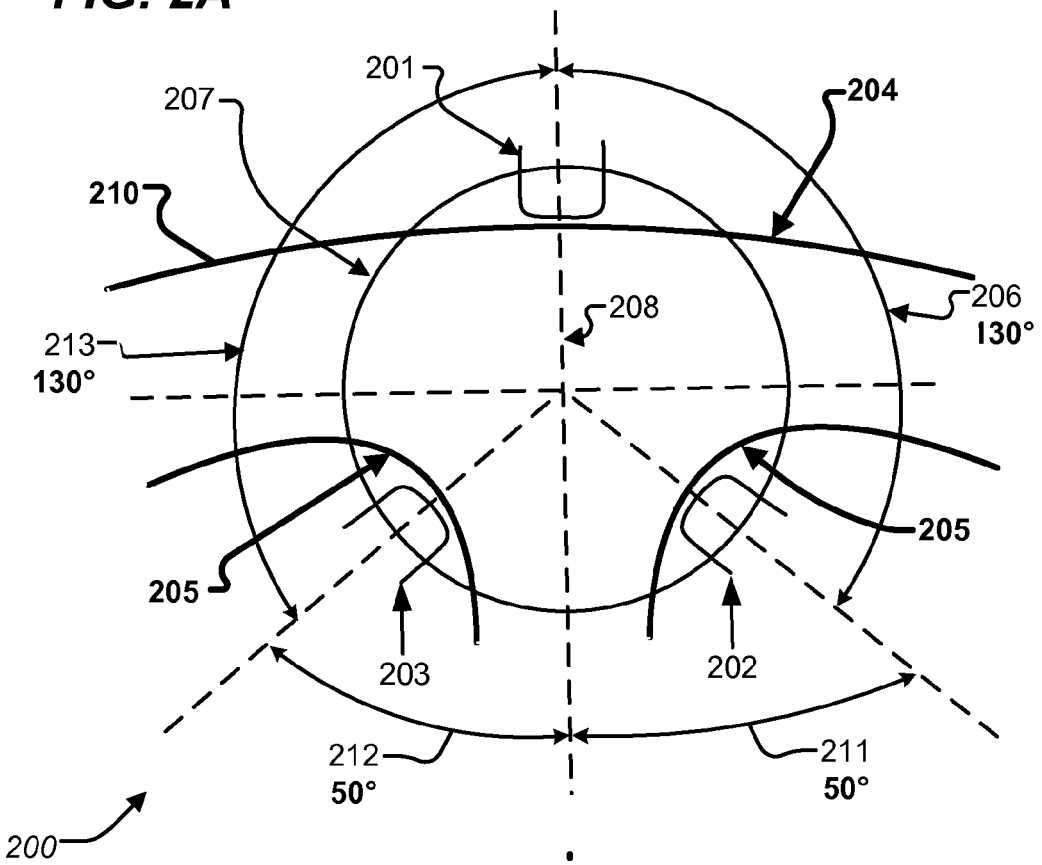
FIG. 2A is an end cutaway view of the tool attached to a handwheel in a typical operational position.

FIG. 2A is a view of a tool 200 in a typical operational position, attached to a handwheel 210. Tool 200 is structurally and operationally similar to tool 100. A first jaw 201, corresponding to one of jaws 103 in FIG. 1, is positioned on the outside portion 204 of a rim of the handwheel 210. A second jaw 202 and third jaw 203, corresponding to a second and third of jaws 103 in FIG. 1, are positioned at the junction of an inside portion 205 of a rim of handwheel 210, and a spoke of handwheel 210. A centerline 208 through the rim and the spoke is provided to show the location of the second jaw 202 and third jaw 203 in relation to the first jaw 201. This relationship is shown as a set of angles 206, 211, 212, and 213. Angle 206 is the angular distance between the first jaw 201 and the second jaw 202, and angle 213 is the angular distance between the first jaw 201 and the third jaw 203. Preferably, angles 206 and 213 each measure 130°. Angles 211 and 212 are the angular distance of the centerline 208 from the second jaw 202 and the third jaw 203, respectively. Preferably, angles 211 and 212 each measure 50°. Dimension 207 depicts the largest diameter of the tool body, about 2¾ inches.

Because FIG. 2 is an end view of tool 200, it may be understood that longitudinal axis 117 is perpendicular to, and intersects, both the plane of the drawing and centerline 208. Thus, the jaws 201-203 are arranged around the longitudinal axis 117, so that each of the jaws 201-203 is equidistant from the axis 117. As the jaws 201-203 are tightened or released, the jaws 201-203 experience angular displacement with respect to the tool body structure 104, causing the tip of each of jaws 201-203 to move closer to or further away from the longitudinal axis 117.

Also, it should be noted that in the embodiment illustrated in FIG. 2A, the three jaws 201-203 are rotationally asymmetric around the longitudinal axis 117. Specifically, instead of each of jaws 201-203 being located 120 degrees from each other, first jaw 201 is located 130 degrees from each of jaws 202 and 203, and jaws 202 and 203 are located 100 degrees apart from each other. This asymmetric arrangement of jaws 201-203 better accommodates the rim and spoke dimensions of a typical handwheel than would a precisely symmetric arrangement.

Figure 2B:
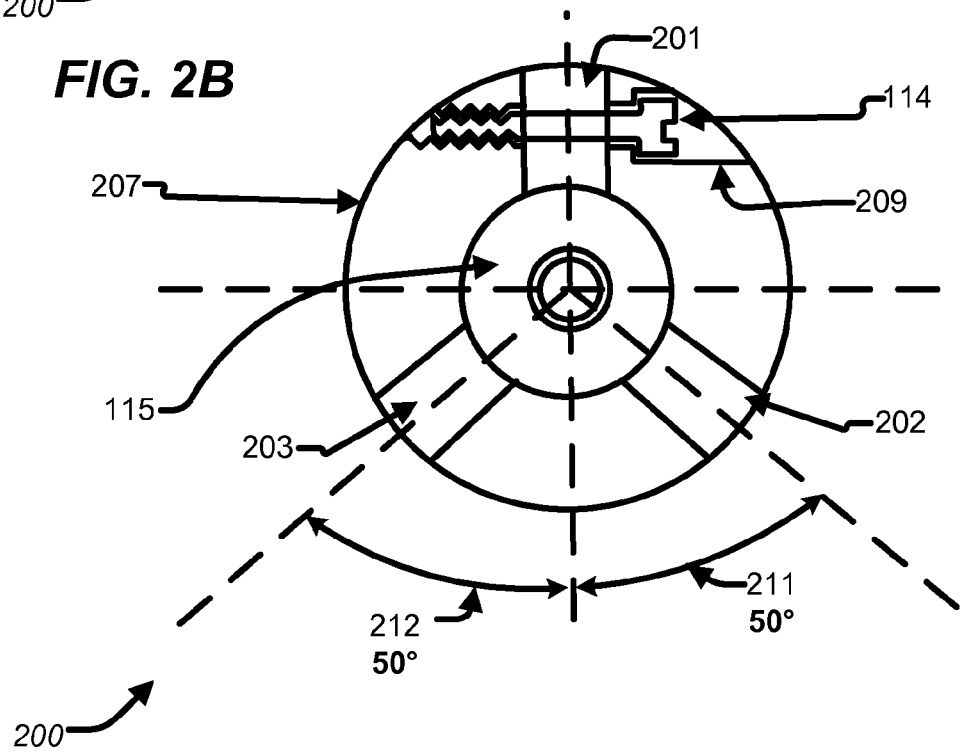
FIG. 2B is a perspective view of the tool from tool body face.

FIG. 2B shows the tool FIG. 2A, from a perspective at the end of the tool body face 102. From this perspective, it may be more clearly seen that second jaw 202 and third jaw 203 are respectively separated from the centerline by an angle 211 and angle 212, which is shown as 50° in the drawing. FIG. 2B also shows the jaw mounting screw 114 within a mounting screwhead counterbore 209. FIG. 2B additionally shows an end view of a drawbar head counterbore 115.

Figure 3A:
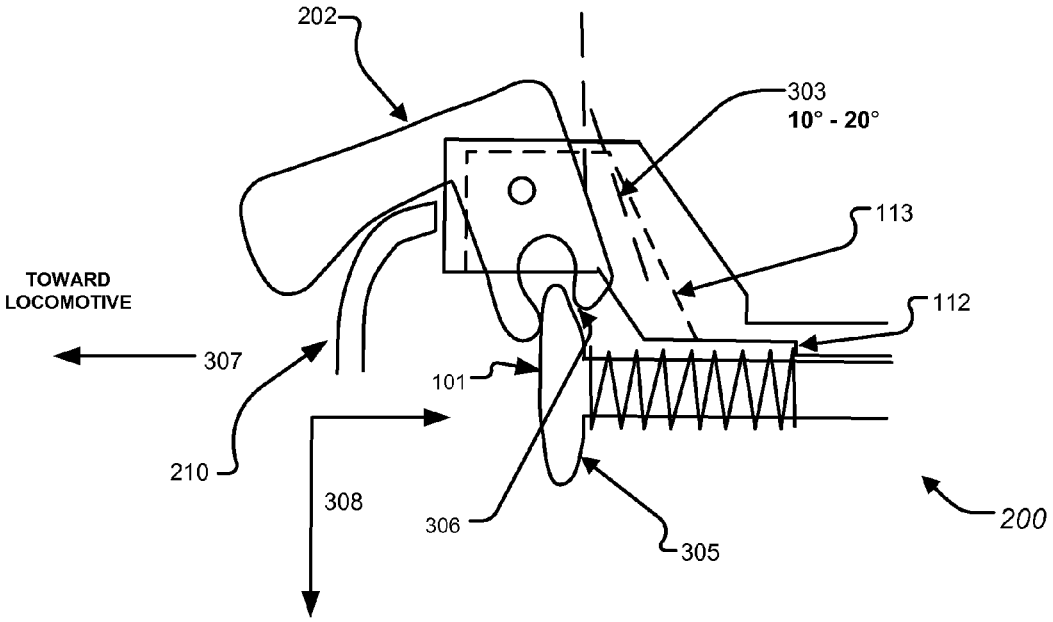
FIG. 3A is a cutaway line view of the tool body through the centerline, showing the tool attached to a first type of handwheel.

FIG. 3A depicts the relationships among the tool body structure 104, the second jaw 202, the drawbar head 101 of drawbar 107, and a handwheel 210 when the tool is in an "applied" position. The outer rim of handwheel 210 is against the tool body face, and the second jaw 202 is touching the back side of the outer rim of handwheel 210. Angle 303 depicts the amount of rotation of the jaw 202 within its respective jaw slot 113 (indicated by a dashed line) when in the applied position. The amount of angle 303 varies among applications because not all handwheels are the same; however, angle 303 is typically around 10° to 20°.

As force is applied to the drawbar 107 via the drawbar nut 110 (not shown in this figure), the drawbar head 101 begins to move toward the drawbar spring counter bore 112. This movement applies pressure to the compression spring 105. Further, this movement causes contact between a number of jaw drawbar head contact surfaces 306 and a drawbar head rounded taper 305, each jaw drawbar head contact surface 306 associated with a respective one of jaws 201-203. The contact between jaw drawbar head contact surfaces 306 and rounded taper 305 causes jaws 201-203 to move angularly toward the handwheel 210. As each of the three jaws 201-203 contact the handwheel 210, multidirectional pressure is applied to the handwheel 210 as designated by force arrows 308. The three jaws 201-203 pull towards each other and pull the handwheel down toward the tool body face. When jaws 201-203 are fully tightened, the tool 200 is substantially perpendicular to the outer rim of the handwheel 210. This connection provides a sturdy device for rotating the handwheel 210. Arrow 307 in FIG. 3A indicates the location of the locomotive body in relation to the tool 200 while the tool 200 is being used.

The depicted handwheel 210 shows one type of handwheel shape used on locomotives. The shape is designated the elongated-C wheel. On this type of wheel, the open side of the "C" faces away from the locomotive body.

Figure 3B:
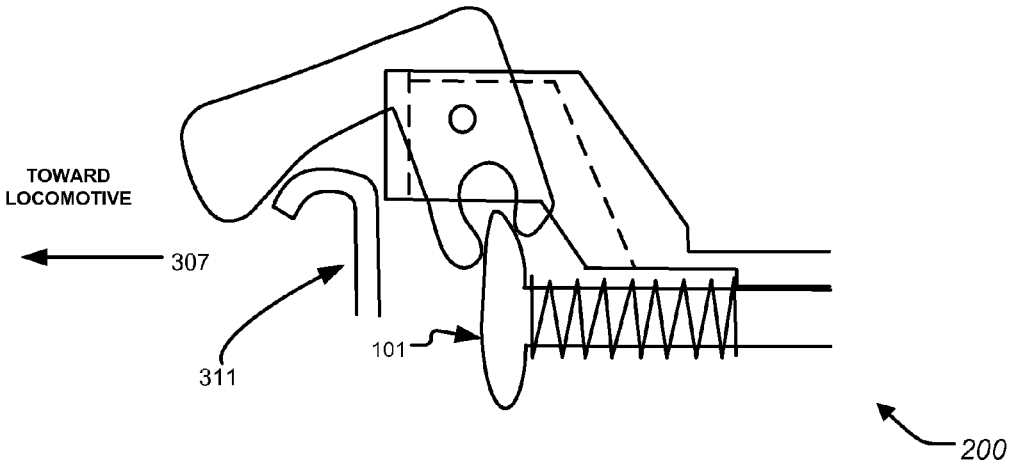
FIG. 3B is a cutaway line view of the tool body through the centerline, showing the tool attached to a different type of handwheel.

FIG. 3B is a similar view to that in FIG. 3A, showing the tool attached to a different type of handwheel. The depicted handwheel 311 in FIG. 3A has a wheel rim including a "C" shape, but has the open side of the "C" facing toward the locomotive body.

Figure 4A:
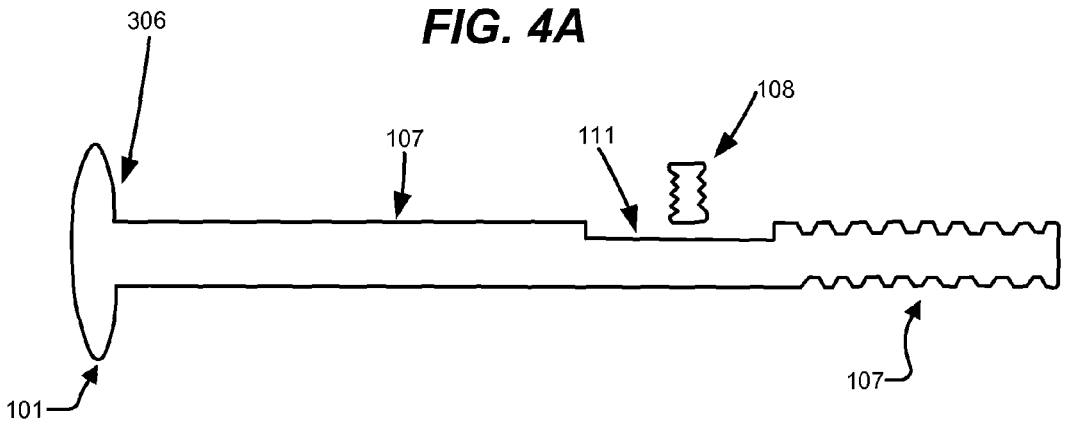
FIG. 4A is a side view of the drawbar and the set screw shown in FIG. 1.

FIGS. 4A-4D are side views of several of the parts in FIG. 1, shown in isolation. FIG. 4A depicts the round drawbar 107 and set screw 108. Also shown is the drawbar head 101, the drawbar head rounded taper 305, the drawbar recess 111 and threaded end 116.

Figure 4B:
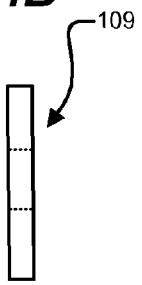
FIG. 4B is a side view of the friction washer shown in FIG. 1.

FIG. 4B is a part view of drawbar nut antifriction washer 109. Preferably, drawbar nut antifriction washer 109 is round, although other washer shapes are possible. Drawbar nut antifriction washer 109 may be made of any suitable material, such as metal, rubber, or plastic.

Figure 4C:
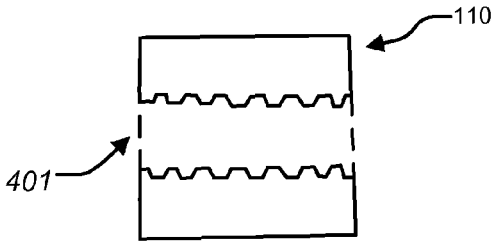
FIG. 4C is a side view of the drawbar nut shown in FIG. 1.

FIG. 4C is a part view of round drawbar nut 110. Drawbar nut 110 contains a threaded inner surface 401. In the illustrated embodiment, the threaded inner surface 401 is threaded with an Acme (trapezoidal) thread pattern, although other thread patterns may be used. The threaded inner surface 401 is constructed to accommodate the threaded end 116 of drawbar 107, so that when drawbar nut 110 is rotated, it causes drawbar 107 to move along longitudinal axis 117.

Figure 4D:
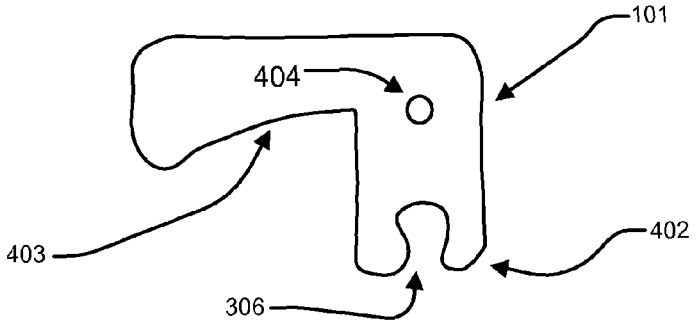
FIG. 4D is a side view of the jaw shown in FIG. 1.

FIG. 4D is a part view of a jaw 103. As previously noted with respect to FIGS. 3A and 3B, each jaw 103 comprises a jaw drawbar head contact surface 306, which contacts drawbar head rounded taper 305. Drawbar head rounded taper 305 and jaw drawbar head contact surfaces 306 are contoured in a complementary fashion so that when drawbar 107 moves, the jaw contact surfaces 306 can slide extensively along drawbar head 101. As a result, jaws 103 are provided with a greater range of angular motion maximum range of angular motion than they would have if drawbar head rounded taper 305 did not exist. In addition, each jaw 103 comprises a spring clearance relief 402, a handwheel contacting surface 403, and a mounting screw hole 404. Spring clearance relief 402 is constructed so that when tool 200 is in the fully released position, the jaw 103 does not contact or interfere with the movement of compression spring 105. The handwheel contacting surface 403 may be contoured to match the shape of a typical handwheel, so that when tool 200 is applied, the jaws 103 will maintain a more secure grip on the handwheel. The mounting screw hole 404 is constructed to accommodate jaw mounting screw 114, so that jaw 103 can be attached to tool body structure 104.

FIG. 5 shows a three-dimensional view of tool 200 attached to handwheel 210. To place the tool into the "attached" position, a user has rotated drawbar nut 110 until each of the jaws 103 is applying pressure to the back side of handwheel 210. As a result, jaws 103 maintain a secure grip on handwheel 210, and the tool extends substantially perpendicular to a plane defined by handwheel 210.

After the tool has been attached to handwheel 210, the user then rotates handwheel 210 by grasping the rotating handle 106, and turning the handwheel in a circular motion until the locomotive handbrake is set or released, as desired. As the wheel turns, the handle 106 freely rotates around its longitudinal axis 117 (FIG. 6), allowing a user to apply substantial torque to handwheel 210 without having to stop to adjust his grip. Thus, the handle 106 helps make the process of rotating the handwheel 210 safer, quicker, and easier. When the user is done rotating the handwheel 210, the user can easily remove tool 200 by rotating drawbar nut 110 in the opposite direction until each of the jaws 103 no longer contacts handwheel 210.

The tool head body, jaws, and drawbar may be made of various materials, and different materials may be used to construct a single tool 100. For example, one version includes a tool head body, jaws, and drawbar that are made with CNC machining out of aluminum round rods and flat stock. The jaw mounting screws and anti-friction washer in this version are constructed of steel. The drawbar nut, in this embodiment is made from nylon, which is used due to the problem in soft materials, like aluminum, gauling when both the threaded end of the drawbar and drawbar nut are made out of aluminum. This can cause the drawbar nut to seize to the threads of the drawbar, thereby causing both components premature wear or damage. In mass production, the tool components can also be cast out of aluminum or aluminum type material that is easily cast, and will withstand the pressures required.

Another suitable material is injection molded plastic of different suitably strong plastic compounds that are known in the art. In mass production, injection molded plastic may provide cost advantages and still meet the mechanical strength required for the tool 100.

Besides injection molded plastic, many other suitable materials are available in both rods and flat material stock in all sizes needed to make the parts described herein. For example, probably the most widely known materials are ABS (acrylonitrile butadiene styrene) and PVC (polyvinyl chloride). These materials are widely available, and can be both molded and machined to size.

Another material widely available is nylon, which is used to construct the drawbar nut in some preferred embodiments. This material is available in both broad and flat stock in all needed sizes. It is easily CNC machined and may be used for the tool body, jaws, drawbar nut, and grip. Another material similar to nylon is Nylatron. It is widely available in all sizes and machineable, and can also be used for any of the tool body, jaws, drawbar nut, and grip.

Yet another material is Acetal, or polyoxymethylene plastic, which is also known by the leading brand name of Delrin. This material is extremely tough, and is commonly used in wheels for industrial class casters which carry extremely heavy loads. It is available in all suitable sizes and machineable to construct all of the parts listed above.

One of the toughest materials that may be used to produce very high quality and durable tools as described herein is UHMW, or ultrahigh molecular weight polyethylene. This material is machineable similar to the other plastics and available in all suitable sizes. This material is an excellent choice for all component parts, and a really good choice especially for constructing the jaws.

As listed above, these materials are but just a few of the available materials that may be used in constructing the devices described. Any material, or combination of materials for different parts, with suitable strength and rigidity to apply the force needed to turn the wheel may be used. A common railroad test for the force needed to finish setting the handbrake is 125 pound weight applied to the outer radius of the wheel as rotational force. While this force may vary as handbrake technologies vary, and a suitable margin of strength such as doubling or tripling this force may be required for some applications, this general guideline provides the testing methodology that may be used to select suitable materials. One preferred combination uses steel for the parts described above as employing steel, uses aluminum for the jaws, and uses plastics for the handle and tool body structure. Another variation uses steel for the spring and pins and plastic for the remaining parts.

FIG. 6 is a cross section view of a tool 300 according to another embodiment. This tool is constructed with only two jaws 103, and has different preferred dimensions to the operating head than the three jaw version, but is otherwise structurally similar with the same parts as the tool 100 of FIG. 1. The depicted tool 300 includes a handle 106 attached to a tool body, the main part of the tool body being the tool body structure 104. A rotating force is therefore applied as the tool is tightened. Further, once tightened in place, the clamping force is applied in at least two directions due to the clamping pressure between the two jaws, and the jaws and tool body face.

The tool body has two jaws 103 connected to the tool body structure. The jaws 103 grasp the wheel when the tool is in use. The jaws 103 are attached to the tool body structure 104 by the jaw mounting screws 114. Each jaw 103 moves inside a jaw slot 113, as depicted. Jaws 103 are adapted to undergo angular displacement with respect to tool body structure 104 in order to apply or release the tool 300.

The tool has a tool body face 102 that rests against the outside of the handwheel, and by its smaller diameter of approximately 2 inches, it provides a stable connection to operate the handwheel. Generally, the two jaw version with its smaller diameter head allows for a smaller, slimmer tool that is easier to carry from engine to engine in railroad operations. The tool is applied at any suitable location along the outside hand wheel rim, either between spokes or near a spoke. It is noted that the depicted two jaw version may therefore be applied at wheel locations where a three jaw version may not be applied in some handwheel designs.

The tool body structure 104 has a ⅜ inch hole drilled through its center, and centered about a longitudinal axis 117. A drawbar 107 functions through this hole to move the jaws 103 back and forth. Drawbar 107 has a drawbar head 101 and a threaded drawbar end 116. In addition, drawbar 107 is attached to a compression spring 105 positioned to press against the drawbar head 101 in a manner to return the jaws 103 to the position shown in FIG. 1 when the tool 300 is not being used. That is, the jaws 103 spring open when not being used. The spring 105 is located behind the drawbar head 101, and inside a drawbar compression spring counter bore 112. There is also a drawbar recess 111 about 1 inch long toward a threaded end 116 of the drawbar 107. A set screw 108 is threaded through the tool body. Set screw 108 contacts a side of drawbar recess 111 to limit the longitudinal displacement of drawbar 107. Also depicted is a drawbar head counter bore 115, which provides space for the drawbar head 101 to operate.

On the threaded end 116 of the drawbar 107 is a drawbar nut 110. The drawbar nut 110, which rotated clockwise, pulls the drawbar head 101 against the drawbar compression spring 105, and thus causes the jaws 103 to rotate into a closed position. The drawbar nut 110 also operates to return the jaws 103 to the open position when it is turned counterclockwise. A drawbar nut antifriction washer 109, located between tool body structure 104 and drawbar nut 110, is provided to keep the drawbar nut 110 from eroding the end of the tool body structure 104.

Tool 300 further includes a rotating handle 106 that surrounds an elongated portion of drawbar 107, and an elongated portion of tool body structure 104. Rotating handle 106 freely rotates about longitudinal axis 117. The freely rotating handle 106 thus provides a user with a spinning grip, allowing him or her to quickly and easily turn a handwheel, as may be best understood with respect to FIG. 5.

As used herein, whether in the above description or the following claims, the terms "comprising," "including," "carrying," "having," "containing," "involving," and the like are to be understood to be open-ended, that is, to mean including but not limited to. Only the transitional phrases "consisting of" and "consisting essentially of," respectively, shall be considered exclusionary transitional phrases, as set forth, with respect to claims, in the United States Patent Office Manual of Patent Examining Procedures (Eighth Edition, August 2001 as revised October 2005), Section 2111.03.

The above described preferred embodiments are intended to illustrate the principles of the invention, but not to limit the scope of the invention. Various other embodiments and modifications to these preferred embodiments may be made by those skilled in the art without departing from the scope of the following claims.

The invention claimed is:

1. A tool for turning a handwheel, the tool comprising:
(a) a tool body, the tool body comprising:
(i) a tool body structure;
(i) two or more jaws connected to the tool body structure, the jaws configured to clamp to a rim of the handwheel, and
(ii) a screw mechanism within the tool body structure for selectively tightening or releasing the jaws, in order to respectively attach or detach the tool from the handwheel rim, wherein the jaws are arranged around the longitudinal axis, and the jaws pivot with respect to the tool body as they are tightened or released;
(b) a handle rotationally connected to the tool body to freely rotate about a longitudinal axis of the tool, with the jaws remaining in a tightened position, while a user applies force transverse to a longitudinal direction of the tool handle to turn the handwheel while gripping the handle;
(c) wherein the tool body further comprises a tool body face that fits flat against an outer junction of a rim of the handwheel, so that when the tool is attached to the handwheel, the jaws apply force in the longitudinal direction, with respect to the tool body, toward the tool body face, clamping it against the handwheel rim such that the tool body is substantially perpendicular to a plane defined by the rim of the handwheel.

2. The tool of claim 1, further comprising a third jaw, wherein the three jaws are positioned to clamp to the handwheel at a junction of an outer rim of the handwheel and a spoke of the handwheel.

3. The tool of claim 2, wherein the three jaws are rotationally asymmetric around the longitudinal axis.

4. The tool of claim 3, wherein two of the jaws are located approximately 100 degrees from each other and symmetrically opposed with respect to the longitudinal axis, and the third jaw is located approximately 130 degrees from the other two jaws.

5. The tool of claim 1, wherein the screw mechanism further comprises a threaded drawbar that extends through an interior of the handle to contact an extension of the jaws, and is adapted to move along the longitudinal axis of the tool body to selectively tighten or release the jaws.

6. The tool of claim 5, wherein
(a) the screw mechanism further comprises a threaded drawbar nut, the threaded drawbar nut adapted to rotate around the longitudinal axis;
(b) the drawbar further comprises a threaded portion that interacts with the drawbar nut, so that when the drawbar nut is rotated, the drawbar moves longitudinally with respect to the tool body in order to selectively tighten or release the jaws.

7. The tool of claim 5, further comprising a compression spring that exerts a longitudinal force against the drawbar in a direction that biases the jaws toward an open position.

8. The tool of claim 5, wherein the drawbar further comprises a drawbar head constructed to apply longitudinal force on a jaw drawbar head contact surface on each of the jaws, causing the jaws to undergo angular displacement with respect to the tool body structure.

9. The tool of claim 8, wherein the drawbar head comprises a rounded taper contoured with respect to the jaw drawbar head contact surface in order to provide an enhanced range of angular displacement of the jaws.

10. A tool for turning a handwheel, the tool comprising:
(a) an elongated handle with a longitudinal hole through the interior of the handle;
(b) a tool body connected to the handle, the tool body comprising:
(i) a tool body structure;
(ii) two or more rigid jaws attached to the tool body structure, the two or more jaws configured to selectively tighten or release in order to selectively attach or detach the tool from a rim of the handwheel;
(iii) a screw mechanism that extends through the longitudinal hole of the handle and is constructed to move longitudinally with respect to the tool body to selectively tighten or release the jaws, wherein the jaws are arranged around the longitudinal axis, and the jaws pivot with respect to the tool body as they are tightened or released;
(iv) wherein the tool body further comprises a tool body face that fits flat against an outer junction of a rim of the handwheel, so that when the tool is attached to the handwheel, so that when the jaws are tightened they apply clamping force on handwheel rim in the longitudinal direction, with respect to the tool body face toward the tool body face, and a clamping force in the transverse direction between the jaws, such that the tool body is substantially perpendicular to a plane defined by the rim of the handwheel.

11. The tool of claim 10, wherein the screw mechanism further comprises a drawbar that extends through an interior of the handle, and is adapted to move along the longitudinal axis to selectively tighten or release the jaws.

12. The tool of claim 11, further comprising a compression spring that exerts a longitudinal force against the drawbar in a direction that biases the jaws toward an open position.

13. The tool of claim 12, wherein each of the jaws comprises a spring clearance relief constructed so that when the jaws are fully released, the jaws do not contact the compression spring.

14. The tool of claim 11, wherein each of the jaws is mounted to the tool body via a respective jaw mounting screw, and the longitudinal displacement of the screw mechanism causes each of the jaws to pivot about its respective jaw mounting screw.

15. A tool for turning a handwheel, the tool comprising:

(a) an elongated handle with a longitudinal hole through the interior of the handle;

(b) a tool body connected to the handle, the tool body comprising:

(i) a tool body structure;

(ii) three jaws connected to the tool body structure, the jaws constructed to clamp to the handwheel at a junction of an outer rim of the handwheel and a spoke of the handwheel;

(iii) a screw mechanism within the tool body structure, the screw mechanism adapted to move longitudinally through the hole for selectively clamping or releasing the jaws, wherein the jaws are arranged around the longitudinal axis, and the jaws pivot with respect to the tool body as they are clamped or released;

(iv) a tool body face that fits flat against an outer junction of the hand wheel rim, so that when the tool is clamped to the handwheel, the jaws apply force in the longitudinal direction, with respect to the tool body, toward the tool body face, clamping the handwheel rim to the tool body face and the tool body is substantially perpendicular to a plane defined by the outer rim of the handwheel.

16. The tool of claim 15, wherein the jaws are contoured to match the shape of a back surface of the handwheel rim.

17. The tool of claim 15, wherein the jaws comprise at least three jaws which are configured to apply clamping force to the handwheel in at least two directions, a first direction longitudinally with respect to the tool body, and a second direction between the jaws.

* * * * *